US010729961B2

(12) United States Patent
Ohle et al.

(10) Patent No.: US 10,729,961 B2
(45) Date of Patent: Aug. 4, 2020

(54) SOCCER BALL KICKING TRAINING DEVICE

(71) Applicant: Robert D. Ohle, Lakewood, CO (US)

(72) Inventors: Robert D. Ohle, Lakewood, CO (US); Jiaxian Peng, Foshan (CN)

(73) Assignee: Robert D. Ohle, Denver, CO (US)

( * ) Notice: Subject to any disclaimer, the term of this patent is extended or adjusted under 35 U.S.C. 154(b) by 0 days.

(21) Appl. No.: 16/329,838

(22) PCT Filed: Sep. 7, 2017

(86) PCT No.: PCT/US2017/050522

§ 371 (c)(1),
(2) Date: Mar. 1, 2019

(87) PCT Pub. No.: WO2018/049054

PCT Pub. Date: Mar. 15, 2018

(65) Prior Publication Data

US 2019/0209906 A1 Jul. 11, 2019

(30) Foreign Application Priority Data

Sep. 9, 2016 (CN) ..... 2016 1 0814802
Sep. 9, 2016 (CN) ..... 2016 2 1047351 U
Sep. 9, 2016 (CN) ..... 2016 3 0466335

(51) Int. Cl.
*A63B 69/00* (2006.01)

(52) U.S. Cl.
CPC ..... *A63B 69/0091* (2013.01); *A63B 69/002* (2013.01); *A63B 2225/09* (2013.01); *A63B 2243/0025* (2013.01)

(58) Field of Classification Search
CPC ..... A63B 69/0091; A63B 69/002; A63B 2225/09; A63B 2243/0025; A63B 63/083;
(Continued)

(56) References Cited

U.S. PATENT DOCUMENTS 2,008,613 A * 7/1935 Hernes ..... A47B 25/00 473/22
2,572,333 A * 10/1951 Greitzer ..... A47B 1/05 273/309

(Continued)

OTHER PUBLICATIONS

Search Report and Written Opinion in PCT/US2017/050522, 7 pages, dated Dec. 20, 2017.

*Primary Examiner* — Mitra Aryanpour
(74) *Attorney, Agent, or Firm* — W. Scott Carson

(57) ABSTRACT

A soccer ball kicking training device (1) having a support base (3) with a column member (5) extending substantially vertically upright therefrom along a first axis (7) and an arm (9) extending outwardly along a second axis (11) between first and second end portions (13,15). The first end portion (13) has a ball (17) attached to it and the second end portion (15) is attached to a hinge mechanism (21) mounted to an upper part (5') of the upright column (5). The hinge mechanism (21) supports the arm (9) for pivotal movement about a horizontal third axis (23) relative to the upright column (5) and the first axis (7). The hinge mechanism (21) additionally includes an inclination angle adjustment mechanism to adjust the up and down angle range of the arm (9) about the horizontal third axis (23) and the device (1) also provides an anti-pinch arrangement for safety.

17 Claims, 5 Drawing Sheets

(58) Field of Classification Search
CPC . A63B 69/0002; A63B 69/00; A63B 69/0026; A63B 69/0079
USPC ..... 473/422, 438, 446, 423, 430, 429, 420, 473/451, 427, 439
See application file for complete search history.

(56) References Cited

U.S. PATENT DOCUMENTS 2,633,320 A * 3/1953 Salmi ..... A63B 69/0091 473/429
3,794,320 A * 2/1974 Salmont ..... A63B 69/0024 473/429
4,042,237 A * 8/1977 Moraru ..... A63B 69/0091 473/429
4,307,888 A * 12/1981 Ohle ..... A63B 69/0091 473/429
4,561,661 A * 12/1985 Walker ..... A63B 69/0091 473/423
4,616,834 A 10/1986 Davis
4,706,964 A * 11/1987 Genovese ..... A63B 69/0079 473/430
5,054,776 A * 10/1991 Wyman ..... A63D 15/04 473/34
5,472,186 A * 12/1995 Paulsen ..... A63B 69/0091 473/429
5,553,848 A * 9/1996 Amron ..... A63B 69/0002 473/416
5,605,326 A * 2/1997 Spear, Jr. ..... A63B 69/0026 473/422
5,836,836 A * 11/1998 Grimes ..... A63B 69/0079 473/427
7,137,909 B2 * 11/2006 Ohle ..... A63B 69/002 473/423
7,806,787 B1 * 10/2010 Gamboa ..... A63B 69/00 473/438
7,811,183 B1 * 10/2010 Ohle ..... A63B 69/002 473/420
8,128,516 B2 * 3/2012 Pan ..... A63B 69/0002 473/422
8,777,781 B2 * 7/2014 Marks ..... A63B 69/002 473/429
8,932,155 B2 * 1/2015 Moore ..... A63B 63/083 473/422
10,183,207 B2 * 1/2019 Mesplay ..... A63B 69/0091 473/438
2008/0280702 A1 * 11/2008 Ohle ..... A63B 69/002 473/423
2009/0286630 A1 * 11/2009 Aguirre ..... A63B 69/002 473/420
2010/0304900 A1 * 12/2010 Gu ..... A63B 69/0002 473/419
2015/0360107 A1 12/2015 Achkar

* cited by examiner

SOCCER BALL KICKING TRAINING DEVICE

BACKGROUND OF THE INVENTION

1. Field of the Invention

This invention relates to the field of sport training devices and more particularly to the field of soccer ball kicking training devices.

2. Discussion of the Background

Soccer or football as it is more commonly known throughout the world is considered "The world's most popular sport" and most influential individual sport in the global sports field. At present in soccer training, the most basic training involves kicking techniques and to this end, skilled soccer personnel have developed a variety of devices which can help soccer players improve their kicking techniques.

Conventional soccer ball kicking training devices such as the kicking training device disclosed in U.S. Pat. No. 4,616,834 have a pivotal rod extending vertically from the base. The pivotal rod rotatably supports the arm and the ball to be kicked is attached to the arm in such a manner that the ball rolls as it passes over the surface (e.g., ground or floor) with which it comes into contact. As disclosed in U.S. Pat. No. 6,475,108, another soccer ball kicking training device includes a base having a fixed base connector, horizontal and vertical members, two ball retainers, height adjustment device, and balls. The ball is supported on a horizontal plane by a weighting component in the base and the fixed base connector is attached to the base. The vertical member and the horizontal member are free to slide within the fixed base connector. The device also includes top and side ball retainers by which the ball can be mounted and/or attached to the device. Conventional soccer ball kicking training devices such as these have a common drawback in that the members connecting with and supporting the balls are generally fixedly attached or positioned on the base. Consequently, the users can only be trained in the positions strictly restricted by the mechanical operation of the device and it is difficult to achieve good, overall training results.

For this reason, the present invention has made improvements in the Chinese patent entitled "A football kicking training device" with the Chinese Authorized Announcement No. 102648030B (Chinese Patent No. ZL2010-8-0040272.4 corresponding to U.S. Pat. No. 7,811,183). The device according to this patent comprises a base which has a flat bottom and a cavity for receiving a rod which can be tightly fitted into the cavity in the base. The rod is held in a vertical direction and further has a hole into which a rotatable shaft is mounted. The rotatable shaft has a lower portion rotatably mounted in the hole of the rod and an upper portion terminating at a bracket or socket. The bracket or socket is sized to receive the ball component to form a ball and bracket or socket joint and the arm has an outer end portion attached to the ball to be kicked by the user of the soccer ball kicking training device. The ball is then attached to the outer end of the arm. The soccer ball kicking training is improved by the fact that the device brings the ball into a defined general area rather than a defined point. This situation trains the users to prejudge the general position of the returned ball, rather than training only in the positions strictly defined by the mechanical operation of the device.

This method of ball placement better simulates the situations usually encountered in the soccer game.

However, this device also has the functional limitations that it can only train the kicking techniques with the inside and outside of the instep, but kicking training with the middle part of the instep cannot be achieved. In this regard, kicking training with the middle part of the instep is one of the key training programs in soccer training. This device also has the structural drawbacks that the joint area between the bracket or socket and the rod for the ball installation is restricted by the inner diameter of the hole for insertion of the rod. Consequently, the movement range of the rod is relatively small and the rod cannot move smoothly during rotation relative to the hole. As a result, the ball cannot simulate the actual spinning in the ball kicking process and there are additional differences compared with actual field training, causing a detrimental impact on the training effort. The joint area is also exposed and may pinch the user presenting a possible safety risk.

With these and other things in mind, the present invention was developed.

SUMMARY OF THE INVENTION

This invention involves a soccer ball kicking training device which is simple in structure, convenient in adjustment, stable, and safe in use. The device includes a support base with a column member secured thereto and extending substantially vertically upright therefrom along a first axis. The device also includes an arm extending outwardly of the upright column 5 along a second axis between first and second end portions. The first or outer end portion of the arm has a ball attached to it and the second end portion is attached to a hinge mechanism that is mounted to an upper part of the upright column. The hinge mechanism supports the arm for pivotal movement about a substantially horizontal, third axis relative to the upright column and the first axis. The arm further has a rotational mechanism for permitting the first end portion of the arm with the ball attached to it to rotate relative to the second end portion about the arm's second axis. The hinge mechanism is rotatably mounted to the upper part of the upright column for rotation about the first axis relative to the upright column and the support base and additionally has an inclination angle adjustment mechanism to adjust the up and down angle range of the arm about the horizontal third axis of the hinge mechanism. In this manner, the ball can be set to contact the ground or set at different heights above the ground for training in a wide variety of kicking techniques.

DETAILED DESCRIPTION OF THE INVENTION

Figure 1:
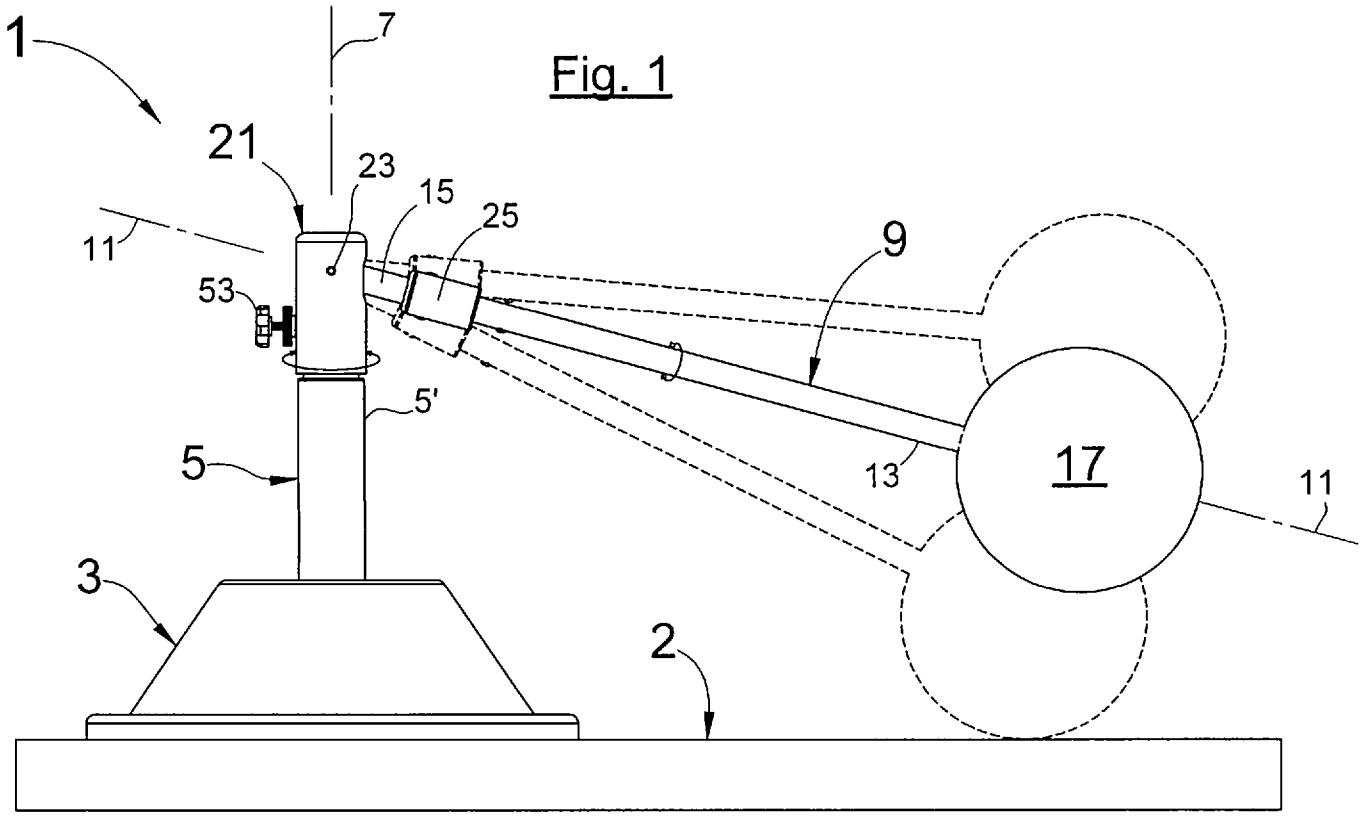
FIG. 1 is a view of the soccer ball kicking training device of the present invention showing the positioning of the ball to rest on the ground or at different heights above the ground for training in a wide variety of kicking techniques.

As shown in FIG. 1, the training device 1 of the present invention includes a support base 3 which has a column member 5 fixedly secured to it and extending substantially vertically upright from the base 3 along the first axis 7. The device 1 also includes an arm 9 extending along a second axis 11 between first and second end portions 13 and 15. The first end portion 13 of the arm 9 has a ball 17 attached to it and the second end portion 15 is attached to a hinge mechanism 21 that is mounted to an upper part 5' of the upright column 5. The hinge mechanism 21 supports the arm 9 for pivotal movement about a substantially horizontal, third axis 23 relative to the upright column 5 and the first axis 7. The arm 9 further has a rotational mechanism 25 for permitting the first end portion 13 of the arm 9 with the ball 17 attached to it to rotate relative to the second end portion 15 about the arm's second axis 11.

Figure 2:
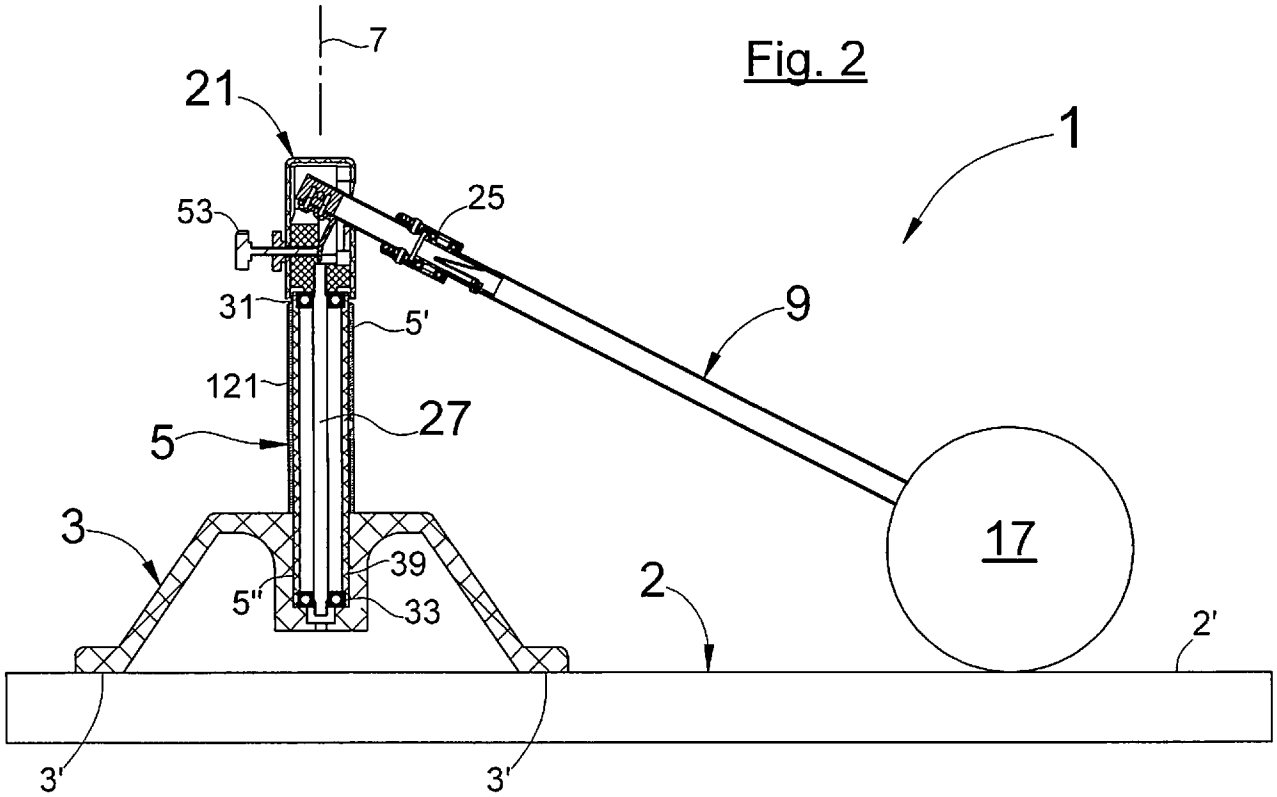
FIG. 2 is a cross-sectional view of the device with the ball positioned to rest on the ground.

The hinge mechanism 21 is rotatably mounted to the upper part 5' of the upright column 5 for rotation about the first axis 7 relative to the upright column 5 and the support base 3. This can be accomplished as shown in FIG. 2 by providing a spindle rod 27 mounted by upper and lower bearings 31 and 33 within the hollow or tubular, upright column 5. The spindle rod 27 extends along the first axis 7 in FIG. 2 and the hinge mechanism 21 is fixedly secured by a pressure fit or otherwise to the upper portion 27' (see also FIG. 3) of the spindle rod 27. The hinge mechanism 21 can then rotate with the spindle rod 27 about the first axis 7 relative to the upright column 5 and support base 3. The lower part 5" of the upright column 5 in FIG. 2 is then fixedly secured in the hole 39 in the support base 3 by a pressure fit or otherwise.

The hinge mechanism 21 of FIGS. 1-4 permits the arm 9 and attached ball 17 to be set so the ball 17 contacts the ground 2 (see FIGS. 1 and 2) or is set at different heights as in FIG. 1 above the ground 2. In this regard, the hinge mechanism 21 has a slotted hole 41 (see FIG. 4) to receive the second end portion 15 of the arm 9 therethrough. The second end portion 15 as discussed above is then mounted to the hinge mechanism 21 for pivotal movement about the horizontal third axis 23 as perhaps best seen FIG. 3.

Figure 3:
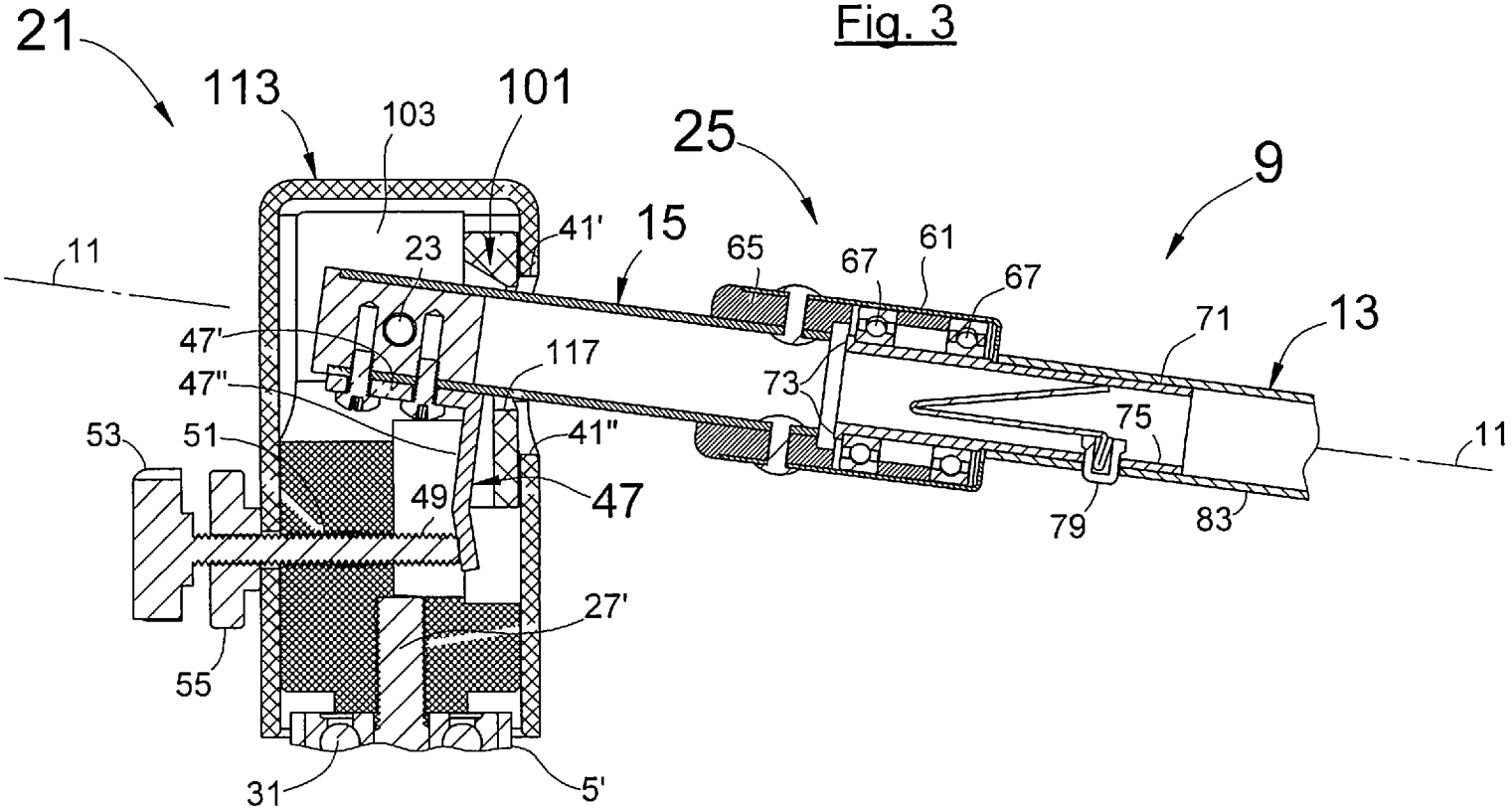
FIG. 3 is an enlarged, cross-sectional view of the hinge mechanism at the top of the device for adjusting the height of the ball from the ground and the arrangement for mounting the first or outer end portion of the arm to the hinge mechanism for rotation about the arm's axis relative to the hinge mechanism
Figure 4:
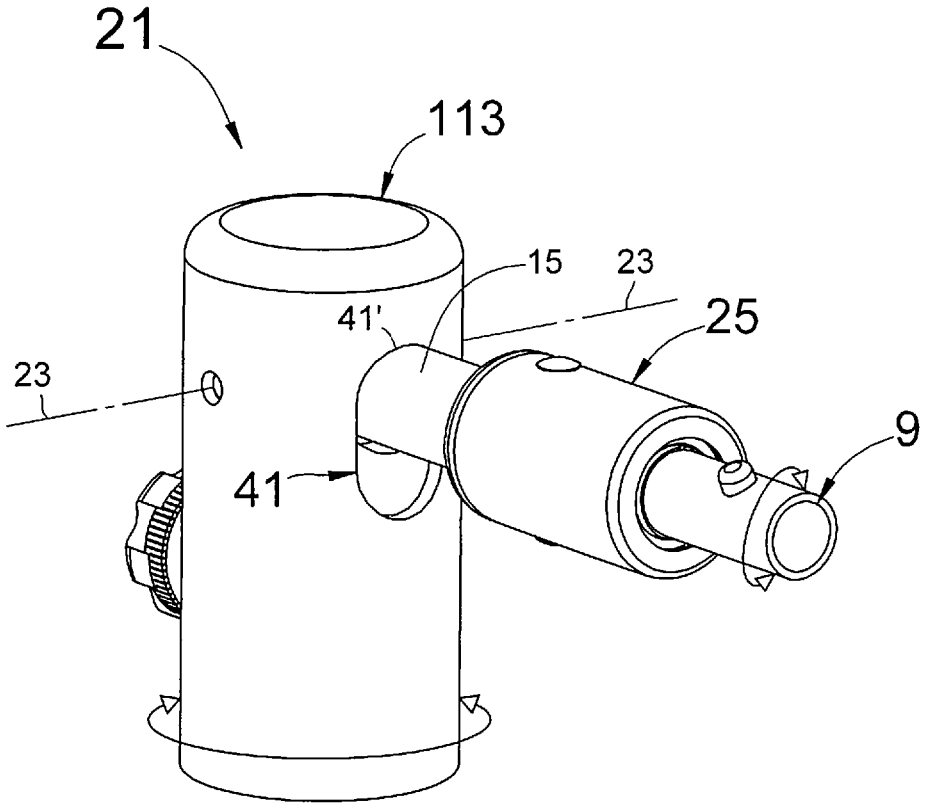
FIG. 4 is an enlarged, perspective view of the hinge mechanism at the top of the device.

The hinge mechanism 21 in FIG. 3 has an inclination angle adjustment mechanism to adjust the up and down angle range of movement of the arm 9 about this third axis 23. The maximum angle range is roughly between the horizontal as in FIG. 1 and about 45 degrees with the ball 17 resting on the ground 2 in FIGS. 1 and 2. However, it can be varied below the horizontal as in FIG. 1 to position the ball 17 at different heights above the ground 2 to provide training in a wide variety of kicking techniques. In the position with the ball 17 resting on the upper, horizontal surface or plane 2' of the ground 2 as in FIG. 2, the bottom of the support base 3 also rests on this same surface or plane 2'. Stated another way, the support base 3 preferably has a planar bottom portion 3' designed to rest on a horizontal surface or plane such as 2' in FIG. 2 with the arm 9 in its lowest angular position then resting the ball 17 on this same plane 2' as projected outwardly from the planar bottom portion 3' of the support base 3.

The angle range adjustments can be accomplished as best seen in FIG. 3 by providing an extension piece 47 on the second end portion 15 of the arm 9. As shown, the extension piece 47 can be roughly 7-shaped or angular with the upper part 47' of the 7-shape attached to the second end portion 15. The lower part 47" of the 7-shape then extends downwardly where it can be contacted by the adjustable shaft 49 to limit the downward angle of the arm 9 from the horizontal about the third axis 23 of the hinge mechanism 21. More particularly, the shaft 49 is preferably threaded as in FIG. 3 and advanced or retracted in the threaded bore or hole 51 in the hinge mechanism 21 by manipulating the outside knob 53 to which the shaft 49 is attached. Rotating the knob 53 and moving the shaft 49 inwardly will then decrease the downward range of the arm 9 as shown in FIG. 3 and withdrawing the shaft 49 as in FIG. 2 will increase the range to its maximum with the ball 17 contacting the ground 2. A threaded lock nut 55 in FIG. 3 can then be provided to help maintain the shaft 49 in the desired position. The upper limit of the range of the arm 9 is preferably with the arm 9 roughly horizontal and can be controlled by having the second end portion 15 of the arm contact the top 41' of the slotted hole 41 in the hinge mechanism 21 of FIGS. 3 and 4.

The device 1 also includes a rotational mechanism 25 in FIG. 1 for permitting the first or outer end portion 13 of the arm 9 with the ball 17 attached to it (see also FIG. 3) to rotate relative to the second end portion 15 about the axis 11. In the illustrated manner of doing so in FIG. 3, a tubular collar 61 is provided that is fixedly attached at one end part 65 to the second end portion 15 of the arm 9. The collar 61 then has internal bearings 67 at the other end to rotatably receive the attachment piece 71. The attachment piece 71 has a lipped rim at 73 to hold it in the collar 61. It then has a tubular wall section 75 for removably attaching the first end portion 13 of the arm 9 thereto for rotation with the first end portion 13 about the axis 11 of the arm 9 relative to the second end portion 15 of the arm 9. One way to accomplish this as shown in FIG. 3 is to provide the tubular wall section 75 with a hole therethrough to receive an outwardly, spring-biased detent 79. In use, the first end portion 13 of the arm 9 is also provided with a hole in its tubular wall section 83 wherein the outwardly, spring-biased detent 79 of the attachment piece 71 will snap into and be received in the hole in the tubular wall section 83 when the two holes are aligned. The attachment piece 71 and first end portion 13 of the arm 9 are then locked together and will move as one.

Figure 5:
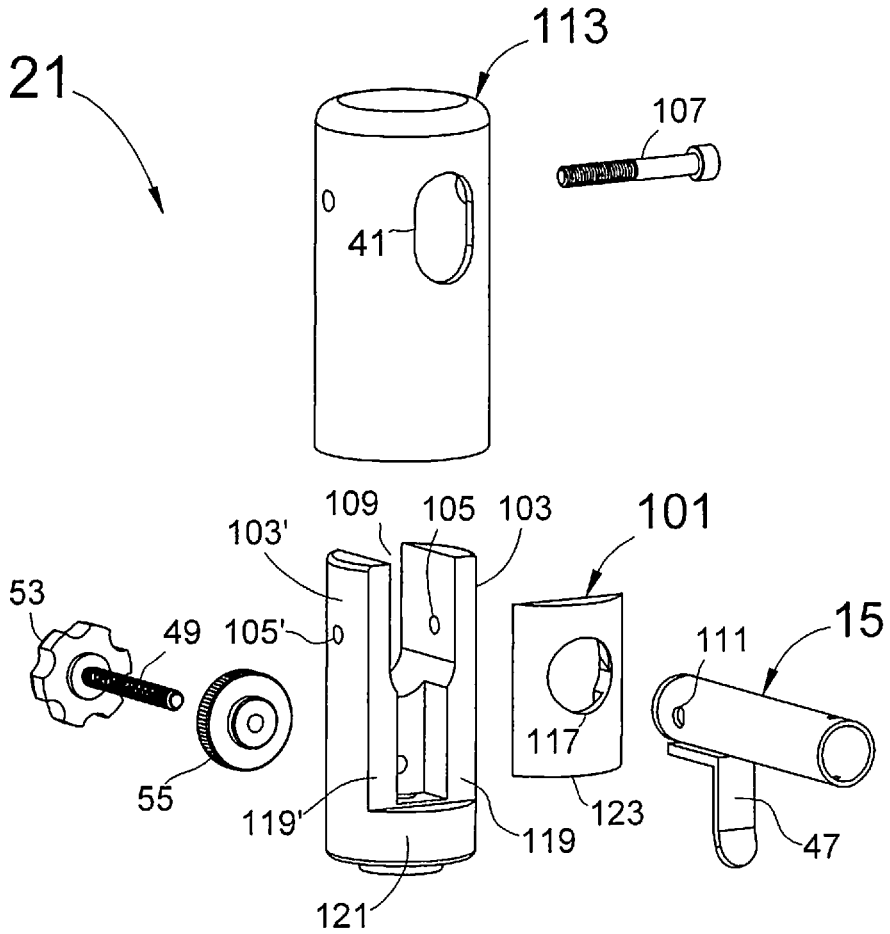
FIG. 5 is an exploded view of the hinge mechanism and the second end portion of the arm showing the height adjustment components and an anti-pinch slider component.

FIG. 5 is an exploded view of the hinge mechanism 21 and the second end portion 15 of the arm 9 showing the height adjustment components discussed above and an anti-pinch slider component 101. As shown, the height adjustment mechanism 21 of FIG. 5 includes support blocks 103 and 103' spaced from each other with respective holes 105 and 105' therethrough to receive a shaft or pivot pin 107 therebetween. The second end 15 of the arm 9 is then mountable in the slotted space 109 in FIG. 5 between the support blocks 103,103' with the shaft or pivot pin 107 received in the hole 111 of the second end portion 15 (see also FIG. 3) and holes 105,105' in the support blocks 103,103' (FIG. 5).

The device 1 of the present invention also has an anti-pinch slider 101 in FIGS. 3 and 5 to reduce the risk that the users may pinch their fingers between the second end portion 15 of the arm 9 (see FIG. 3) and the hinge mechanism 21 including its protective cover 113 when adjusting the inclination angle range of the arm 9 as discussed above. To this aim, the slotted hole 41 in the protective cover 113 (see FIG. 3 is preferably beveled or sloped at its top 41' and bottom 41") inwardly toward the anti-pinch slider 101. In this manner, the anti-pinch slider 101 in FIGS. 3 and 5 greatly reduces the exposed space or area between the top 41' and bottom 41" of the slotted hole 41 in the protective cover 113 (FIG. 3) and the moving second end portion 15 of the arm 9.

In this regard, the anti-pinch slider 101 has a slotted hole 117 (FIG. 5) to receive the second end portion 15 of the arm 9. As shown in FIGS. 3 and 5, the anti-pinch slider 101 is mounted in sliding contact with the support blocks 103,103' of the hinge mechanism 21 and moves vertically up and down with the movement of the of the second end portion 15 of the arm 9 relative to the hinge mechanism 21. The support blocks 103,103' in this regard have vertically extending surfaces 119,119' in FIG. 5 contacting the vertically extending surface on the back side of the anti-pinch slider 101. Additionally, hinge mechanism 21 has a portion 121 (FIG. 5) extending substantially horizontally between the support blocks 103,103' wherein at the lowest vertical position of the anti-pinch slider 101, the bottom surface 123 thereof can contact this portion 121 of the hinge mechanism 21. When assembled as in FIG. 3, the second end portion 15 of the arm 9 is then received through the aligned slotted hole 41' in the protective cover 113 of the hinge mechanism 21, the slotted hole 117 in the anti-pinch slider 101, and the slotted hole 109 (FIG. 5) between the support blocks 103,103'. If desired, an outer protective cover 121 in FIG. 2 can also be provided on the upright column 5.

The above disclosure sets forth a number of embodiments of the present invention described in detail with respect to the accompanying drawings. Those skilled in this art will appreciate that various changes, modifications, other structural arrangements, and other embodiments could be practiced under the teachings of the present invention without departing from the scope of this invention as set forth in the following claims. In particular, it is noted that the word substantially is utilized herein to represent the inherent degree of uncertainty that may be attributed to any quantitative comparison, value, measurement or other representation. This term is also utilized herein to represent the degree by which a quantitative representation may vary from a stated reference without resulting in a change in the basic function of the subject matter involved.

We claim:

1. A soccer ball kicking training device including:

a support base with a column member secured thereto and extending substantially vertically upright therefrom along a first axis, an arm extending along a second axis between first and second end portions and having a ball attached to the first end portion and a hinge mechanism attached to the second end portion, said hinge mechanism being mounted to an upper part of the upright column member to support the arm for pivotal movement relative to said upright column member and first axis about a substantially horizontal, third axis, said hinge mechanism being fixed relative to the third axis, and said arm having a rotational mechanism for permitting the first end portion of the arm with the hall attached thereto to rotate relative to the second end portion about said second axis, said hinge mechanism has an inclination angle adjustment mechanism to adjust the up and down angle range of the arm and the second axis thereof relative to the first axis and about the horizontal third axis relative to the hinge mechanism, and wherein the inclination angle adjustment mechanism of the hinge mechanism includes a knob with an adjustment shaft attached thereto extending into the interior of the the second end portion to limit the downward angle range of the arm about the horizontal third axis of the hinge mechanism.

2. A soccer ball kicking training device including:

a support base with a column member secured thereto and extending substantially vertically upright therefrom along a first axis, an arm extending along a second axis between first and second end portions and having a ball attached to the first end portion and a hinge mechanism attached to the second end portion, said hinge mechanism being mounted to an upper part of the upright column member to support the arm for pivotal movement relative to said upright column member and first axis about a substantially horizontal, third axis, said arm having a rotational mechanism for permitting the first end portion of the arm with the ball attached thereto to rotate relative to the second end portion about said second axis, and said hinge mechanism has an inclination angle adjustment mechanism to adjust the up and down angle range of the arm and the second axis thereof about the horizontal third axis and wherein said upright column member is hollow and has a spindle rod mounted by upper and lower bearings therein to extend along the first axis, said spindle rod being rotatable relative to the upright column member about said first axis, said hinge mechanism being secured to an upper portion of the spindle rod to rotate therewith about the first axis relative to the upright column member.

3. The device of claim 2 wherein the hinge mechanism is rotatably mounted to the upper part of the upright column member for rotation about said first axis relative to the upright column member and the support base.

4. The device of claim 2 wherein the support base has a hole therein to receive a lowerpart of the upright column member therein.

5. The device of claim 1 wherein the adjustment shall is threaded and received in a threaded hole in the hinge mechanism.

6. The device of claim 2 wherein the support base has a planar bottom portion and the arm has a lowest angular position where the ball rests on a plane projected outwardly from the planar bottom portion of the support base.

7. The device of claim 2 wherein said rotational mechanism of said aim permits the first end portion of the arm with the ball attached thereto to freely rotate relative to the second end portion about said second axis.

8. The device of claim 2 wherein the hinge mechanism is rotatably mounted to the upper part of the upright column member for free rotation about said first axis relative to the upright column member.

9. A soccer ball kicking training device including:

a support base with a column member secured thereto and extending substantially vertically upright therefrom along a first axis, an arm extending along a second axis between first and second end portions and having a ball attached to the first end portion and a hinge mechanism attached to the second end portion, said hinge mechanism being mounted to an upper part of the upright column member to support the arm for pivotal movement relative to said upright column member and first axis about a substantially horizontal, third axis, said arm having a rotational mechanism for permitting the first end portion of the arm with the ball attached thereto to rotate relative to the second end portion about said second axis, and said hinge mechanism has an inclination angle adjustment mechanism to adjust the up and down angle range of the arm and the second axis thereof about the horizontal third axis wherein the hinge mechanism has a first slotted hole therein to receive the second end portion of the arm therethrough and said device further includes an anti-pinch slider positioned adjacent the first slotted hole of the hinge mechanism, said anti-pinch slider having a second slotted hole therein to receive the second end portion of the arm therethrough, said anti-pinch slider being in sliding contact with the hinge mechanism and movable with the second end portion of the arm relative to the hinge mechanism.

10. The device of claim 5 further including a protective cover positionable over the hinge mechanism and having a third slotted hole to receive the second end portion of the arm therethrough therein aligned with the first, second, and third slotted holes aligned.

11. The device of claim 5 wherein the hinge mechanism has support blocks spaced from each other with respective holes therethrough to receive a shaft therebetween with the second end portion of the arm mounted on the shaft.

12. The device of claim 11 wherein the support blocks have respective vertically extending surfaces and said anti-pinch slider has a vertically extending surface in sliding contact with the vertically extending surfaces of the support blocks.

13. The device of claim 12 wherein the hinge mechanism further includes a portion extending substantially horizontally between the spaced-apart support blocks and said anti-pinch slider has a bottom surface with said anti-pinch slider being vertically movable to contact the bottom surface thereof with the horizontally extending portion of the hinge mechanism.

14. A soccer ball kicking training device including:

a support base with a column member secured thereto and extending substantially vertically upright therefrom along a first axis, an arm extending along a second axis between first and second end portions and having a bail attached to the first end portion and a hinge mechanism attached to the second end portion, said hinge mechanism being mounted to an upper part of the upright column member to support the arm for pivotal movement relative to said upright column member and first axis about a substantially horizontal, third axis, said arm having a rotational mechanism for permitting the first end portion of the arm with the ball attached thereto to rotate relative to the second end portion about said second axis, and said hinge mechanism has an inclination angle adjustment mechanism to adjust the up and down angle range of the arm and the second axis thereof about the horizontal third axis wherein the inclination angle adjustment mechanism of the hinge mechanism includes a knob with an adjustment shaft attached thereto extending into the interior of the hinge mechanism to contact an extension piece on the second end portion to limit the downward angle range of the arm about the horizontal third axis of the hinge mechanism wherein the extension piece on the second end portion of the arm is substantially 7-shaped.

15. The device of claim 14 wherein the upper part of the 7-shaped piece is attached to the second end portion of the arm and the lower part of the 7-shaped piece is contacted by the adjustment shaft to pivotally move the 7-shaped piece and attached second end portion of the arm about the horizontal third axis of the hinge mechanism and to limit the downward angle range of the arm about the horizontal third axis of the hinge mechanism.

16. A soccer bail kicking training device including:

a support base with a column member secured thereto and extending substantially vertically upright therefrom along a first axis, an arm extending along a second axis between first and second end portions and having a bail attached to the first end portion and a hinge mechanism attached to the second end portion, said hinge mechanism being mounted to an upper part of the upright column member to support the arm for pivotal movement relative to said upright column memberand first axis about a substantially horizontal, third axis, said arm having a rotational mechanism for permitting the first end portion of the arm with the ball attached thereto to rotate relative to the second end portion about said second axis, and said hinge mechanism has an inclination angle adjustment mechanism to adjust the up and down angle range of the arm and the second axis thereof about the horizontal third axis and wherein the rotational mechanism for permitting the first end portion of the arm with the ball attached thereto to rotate relative to the second end portion about said second axis includes a collar fixedly attached at one end part to the second end portion of the arm and having bearings at the other end part to rotatably receive an attachment piece for removably attaching the first end portion of the arm thereto for rotation with said first end portion about the second axis of the arm relative to the second end portion.

17. The device of claim 16 wherein the attachment piece has a tubular wall section with a hole therethrough to receive and outwardly, spring-biased detent and the second end portion of said arm has a tubular wall section with a hole therethrough to receive the outwardly, spring-biased detent of the attachment piece when the holes of the attachment piece and second end portion are aligned.

* * * * *